US007828922B2

(12) United States Patent
Kronzer

(10) Patent No.: US 7,828,922 B2
(45) Date of Patent: Nov. 9, 2010

(54) METHODS FOR MAKING FALSE WATERMARKS IN A FIBROUS SUBSTRATE

(75) Inventor: Frank J. Kronzer, Woodstock, GA (US)

(73) Assignee: Neenah Paper, Inc., Alpharetta, GA (US)

( * ) Notice: Subject to any disclaimer, the term of this patent is extended or adjusted under 35 U.S.C. 154(b) by 407 days.

(21) Appl. No.: 11/877,733

(22) Filed: Oct. 24, 2007

(65) Prior Publication Data

US 2009/0111039 A1 Apr. 30, 2009

(51) Int. Cl.
*B41M 5/00* (2006.01)
*B44C 1/165* (2006.01)

(52) U.S. Cl. ..... 156/230; 428/195.1

(58) Field of Classification Search ..... 430/104, 430/125.31, 125.3; 428/195.1; 156/230
See application file for complete search history.

(56) References Cited

U.S. PATENT DOCUMENTS

| | | | | |
|---|---|---|---|---|
| 3,922,445 | A | 11/1975 | Mizuno et al. | |
| 4,785,313 | A | 11/1988 | Higuma et al. | |
| 4,863,781 | A * | 9/1989 | Kronzer | 428/200 |
| 5,501,902 | A | 3/1996 | Kronzer | |
| 5,776,543 | A | 7/1998 | Takeuchi et al. | |
| 5,798,179 | A | 8/1998 | Kronzer | |
| 6,277,229 | B1 | 8/2001 | Popat et al. | |
| 6,393,980 | B2 | 5/2002 | Simons | |
| 6,450,633 | B1 | 9/2002 | Kronzer | |
| 6,506,445 | B2 | 1/2003 | Popat et al. | |
| 6,539,856 | B2 | 4/2003 | Jones | |
| 6,634,289 | B2 | 10/2003 | Foster et al. | |
| 6,849,370 | B2 | 2/2005 | Wagner et al. | |
| 6,871,950 | B2 | 3/2005 | Higuma et al. | |
| 6,916,751 | B1 | 7/2005 | Kronzer | |
| 7,097,899 | B2 | 8/2006 | Daems et al. | |
| 7,238,410 | B2 | 7/2007 | Kronzer | |
| 2002/0146544 | A1 | 10/2002 | Kronzer | |
| 2003/0035917 | A1 | 2/2003 | Hyman | |
| 2004/0018355 | A1 | 1/2004 | Shikano | |
| 2004/0023008 | A1 | 2/2004 | Rosset | |
| 2006/0019043 | A1 | 1/2006 | Kronzer | |
| 2006/0283540 | A1 | 12/2006 | Kronzer | |
| 2007/0221317 | A1 | 9/2007 | Kronzer | |

* cited by examiner

*Primary Examiner*—John L Goodrow
(74) *Attorney, Agent, or Firm*—Dority & Manning, P.A.

(57) ABSTRACT

Methods of making fibrous webs having a visible transparency variation image and products constructed from such methods are generally disclosed. The variation in transparency creates a transparency variation image in the fibrous substrate in the form of a false watermark and/or a false shadow mark. In the method disclosed, a transfer sheet having a transfer coating is utilized. A portion of the transfer coating is removed from the transfer sheet by heat transfer with a printable sheet having a toner image applied thereon. The transfer coating of the transfer sheet includes a powdered thermoplastic polymer and a film-forming binder. The film-forming binder can have a melting point that is less than that of the powdered thermoplastic polymer. In the final step of the method, the remaining transfer coating is transferred to a fibrous substrate to form the transparency variation image in the fibrous substrate.

24 Claims, 9 Drawing Sheets

METHODS FOR MAKING FALSE WATERMARKS IN A FIBROUS SUBSTRATE

BACKGROUND OF THE INVENTION

In the past, watermarks or a shadow marks have been used to create transparency images in paper. Typically, watermarks and shadow marks are produced by inducing localized variations in the thickness of the cellulosic web. This variation in thickness, in turn, creates localized variations in the opacity of the paper, and so creates a contrast which makes the watermark visible, particularly in transmitted light. The desired localized variation in web thickness is typically effected by fiber displacement by means of a dandy roll which runs on top of the wet web on the wire of a Fourdrinier paper machine. The dandy roll imprints the desired image into the wet web creating variations in thickness that define a watermark or shadow mark.

However, the image imprinted by the dandy rolls cannot be easily changed. The dandy roll has protrusions (to form watermarks) or depressions (to form shadow marks) that create the variation in thickness during the web formation process (e.g., while the web is still wet) resulting in the variation in transparency. Changing these protrusions or depressions in the dandy roll is not practical in most instances. Thus, in order to form a different image, a new dandy roll is required. However, the production of dandy rolls is typically an expensive process.

Another method can be used to produce transparency images with a printer such as a Flexographic printer or a screen printer. This method, sometimes called false watermarking, is done by printing a paper web with inks containing materials such as oils, waxes or glycerin which penetrate the paper but which have little or no colorant. The printed areas are less opaque due to replacement of some fiber/air interfaces with fiber/ink interfaces. Although this method does produce transparency images, it is not easily adaptable to customized production, since the time and expense required to prepare a screen or flexo plate cannot be justified economically unless a large number of prints are produced.

As such, a need currently exists for a more efficient and versatile method of making a fibrous substrate (e.g., paper) that has variations in the opacity of the substrate, while allowing the patterns or designs to vary as desired. Ideally, the method will make use of digital printing, which is readily adaptable and versatile, enabling production of prints without the need for plates or screens.

SUMMARY OF THE INVENTION

In one embodiment, a method of producing a transparency variation image in a fibrous substrate is generally provided. In general, a portion of a transfer coating from a transfer sheet is removed via heat transfer with a printable sheet defining a printable surface. The portion of the transfer coating removed from the transfer sheet corresponds to areas where a toner ink is present on the printable surface of the printable sheet. The transfer coating includes a film-forming binder and a powdered thermoplastic polymer. Optionally, the transfer sheet can also include at least one surfactant, such as a nonionic surfactant. The transfer is performed at transfer temperature of about 50° C. to about 150° C. Next, the transfer coating remaining on the transfer sheet is transferred to a fibrous substrate at a transfer temperature greater than about 150° C. to form a transparency variation image in the fibrous substrate.

In another embodiment, an intermediate imaged transfer sheet for use in forming a transparency variation image in a fibrous substrate is generally disclosed. The intermediate imaged transfer sheet generally includes a transfer coating overlaying a release layer overlaying a base sheet. The transfer coating defines an outer surface of the intermediate imaged transfer sheet, and defines an image. The transfer coating includes a film-forming binder and a powdered thermoplastic polymer. The powdered thermoplastic polymer can have a melting point of greater than about 100° C. The film-forming binder can have a melting point of about 50° C. to about 150° C.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which.

Figure 1:
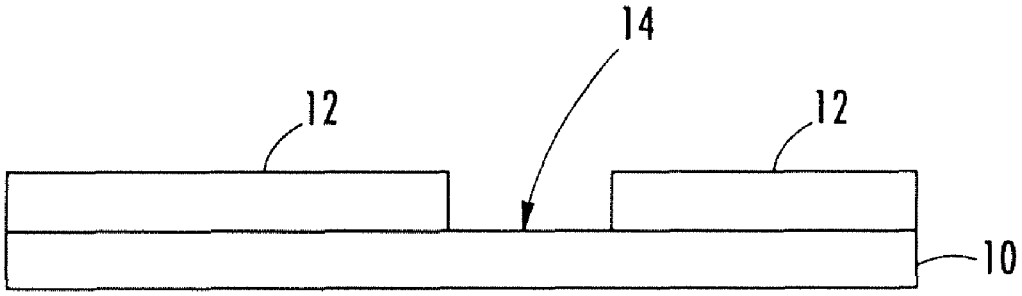
FIGS. 1-7 sequentially depict an exemplary method of making a false watermark according to the present invention.

Repeat use of reference characters in the present specification and drawings is intended to represent the same or analogous features or elements of the present invention.

DEFINITIONS

As used herein, "false watermarks" and "false shadow marks" collectively refer to a variation or variations in transparency in a substrate without a significant variation in thickness, if any, in the Z-direction of the substrate (as opposed to watermarks or shadow marks). The false watermark images are defined by areas of the substrate that are more transparent than the rest of the substrate. Thus, the false watermark image appears as a lighter image in the substrate. On the other hand, shadow mark images are defined by areas of the substrate that are less transparent than the rest of the substrate. Thus, the false shadow mark image appears as a darker image in the substrate. Both the false watermarks and false shadow marks can be seen by the naked eye, especially when using light transmitted through the substrate.

As used herein, a "transparency variation image" refers to any image, including pictures, designs, characters (e.g., letters or numbers), or the like, created in a substrate via a false watermark or a false shadow mark.

As is known to those skilled in the art, "Sheffield smoothness" is well established for measuring and quantifying the smoothness (or roughness) of a printing medium (e.g., a paper sheet). As used herein, the Sheffield smoothness value can be determined according to the standardized method TAPPI Test Methods, T 538 om-88, Vol. 1, 1991 (published by TAPPI Press, Atlanta, Ga.), which is hereby incorporated by reference into this specification. Commercial instruments are available for determining the Sheffield smoothness, such as Model 538 Paper Smoothness Tester from Technologies, Inc., of Queensbury, N.Y., as well as the Sheffield Paper Gage, available from Testing Machines Inc., of Amityville, N.Y.

As used herein, the term "printable" is meant to include enabling the placement of an image on a material by any means, such as by direct and offset gravure printers, silk-screening, typewriters, laser printers, laser copiers, other toner-based printers and copiers, dot-matrix printers, and ink jet printers, by way of illustration. Moreover, the image composition of the present invention may be any of the toner inks or other toner compositions typically used in printing processes which make use of toners.

The term "toner ink" is used herein to describe an ink which is adapted to be fused to the printable substrate with heat.

The term "molecular weight" generally refers to a weight-average molecular weight unless another meaning is clear from the context or the term does not refer to a polymer. It long has been understood and accepted that the unit for molecular weight is the atomic mass unit, sometimes referred to as the "dalton." Consequently, units rarely are given in current literature. In keeping with that practice, therefore, no units are expressed herein for molecular weights.

As used herein, the term "cellulosic nonwoven web" is meant to include any web or sheet-like material which contains at least about 50 percent by weight of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes nonwoven webs prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

The term "thermoplastic polymer" is used herein to mean any polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers, polyvinyl chloride, poly vinyl acetate, etc., and copolymers thereof.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Generally speaking, the present invention is directed to methods of making fibrous substrates having a visible variation in transparency and products used in and constructed from such methods. The variation in transparency creates a transparency variation image in the fibrous substrate as a false watermark(s) and/or false shadow mark(s).

The transparency variation image is defined in the substrate by areas which have a different transparency than the remainder of the substrate, without substantially changing the thickness of the substrate (e.g., while keeping a substantially uniform thickness throughout the substrate). For example, false watermark images are defined by areas of the substrate that are more transparent than the rest of the substrate. Thus, the false watermark image appears as a lighter image in the substrate. On the other hand, shadow mark images are defined by areas of the substrate that are less transparent than the rest of the substrate. Thus, the false shadow mark image appears as a darker image in the substrate. Both the false watermarks and false shadow marks can be seen by the naked eye, especially when using transmitted light. The transparency variation image can take on any form, design, character, shape, or other image on the substrate.

The methods of the present disclosure enable a user to apply a personalized transparency variation image to a fibrous substrate. Essentially, any picture, design, character, shape, or other image that the user can print onto a printable sheet can be transferred as a false watermark or false shadow mark to a fibrous substrate according to the methods of the present disclosure. As such, the present disclosure describes inexpensive and flexible methods of producing transparency variation images on a fibrous substrate, without the need for an expensive and unchangeable dandy roll associated with true watermarks and true shadow marks or the need to prepare printing plates or screens.

Additionally, the presently described methods avoid the necessity of imprinting true watermarks into a fibrous web during the web formation—as in the wet stage of the paper forming process. Thus, anyone who desires to imprint a transparency variation image into a fibrous substrate does not have to contact the manufacturer of the substrate, but can add a transparency variation image to a commercially available substrate.

I. Printing a Toner Image on a Printable Sheet

In order to produce a transparency variation image on a fibrous substrate, a toner image is first applied (e.g., printed) onto a printable sheet. In a particular embodiment, the toner image can be digitally printed onto the printable sheet via a laser printer or copier. Digital electrographic toner printing (often referred to as laser printing) is a well-known method of printing high quality images onto a paper sheet. Another type of digital toner printing is called digital offset printing.

Typically, the composition of the toner ink will vary with the printing process utilized. Though not required, the image can be printed utilizing black toner ink only, so as to produce a black and white image. The use of a black and white image can reduce ink costs when compared to the formation of a colored image which utilizes several differently colored toner inks.

The image formed on the printable surface of the printable sheet can be either a "positive" or "negative" image. A "positive" image is an image that is defined by the ink applied to the printable sheet. To create a positive image, ink is applied only to those areas required to form the image. Thus, the image is positively defined in the areas of the printable sheet where the ink was applied (e.g., the black areas on the printable surface when using black ink on a white printable sheet). For example, the black letters on this sheet of paper are positively defined images because the ink is applied only to the areas required to form the letters. On the other hand, a "negative" image is an image that is defined by the area of the printable surface that is free of ink. To create a negative image, ink is applied to the entire surrounding surface area, except where required to form the image. Thus, the image is negatively defined in the areas of the printable surface that is free of ink (e.g., the white areas on the printable surface when using black ink on a white printable surface).

The image printed onto the printable sheet (either positively or negatively) will ultimately be the template for the transparency variation image. Due to the vast availability of toner printing processes, nearly every consumer easily can produce his or her own image for use as a template to make a transparency variation image in a fibrous substrate.

Referring to FIG. 1, an exemplary printable sheet 10 is shown having a toner ink 12 applied to its printable surface 14. In FIG. 1, an image is negatively formed in the area free of toner ink, with the remainder of the surface area of the printable surface 14 having toner ink 12 applied thereto. Any suitable sheet (e.g., web, film, or a combination) having a printable surface 14 can be utilized as the printable sheet 10 in accordance with the disclosed method. For example, the printable sheet 10 can be a cellulosic nonwoven web which defines a printable surface 14. In one embodiment, the printable sheet 10 has a relatively smooth printable surface 14 to allow for crisp images printed onto the surface. For example, the printable surface 14 can have a Sheffield smoothness of less than about 100, such as less than about 75.

Figure 8:
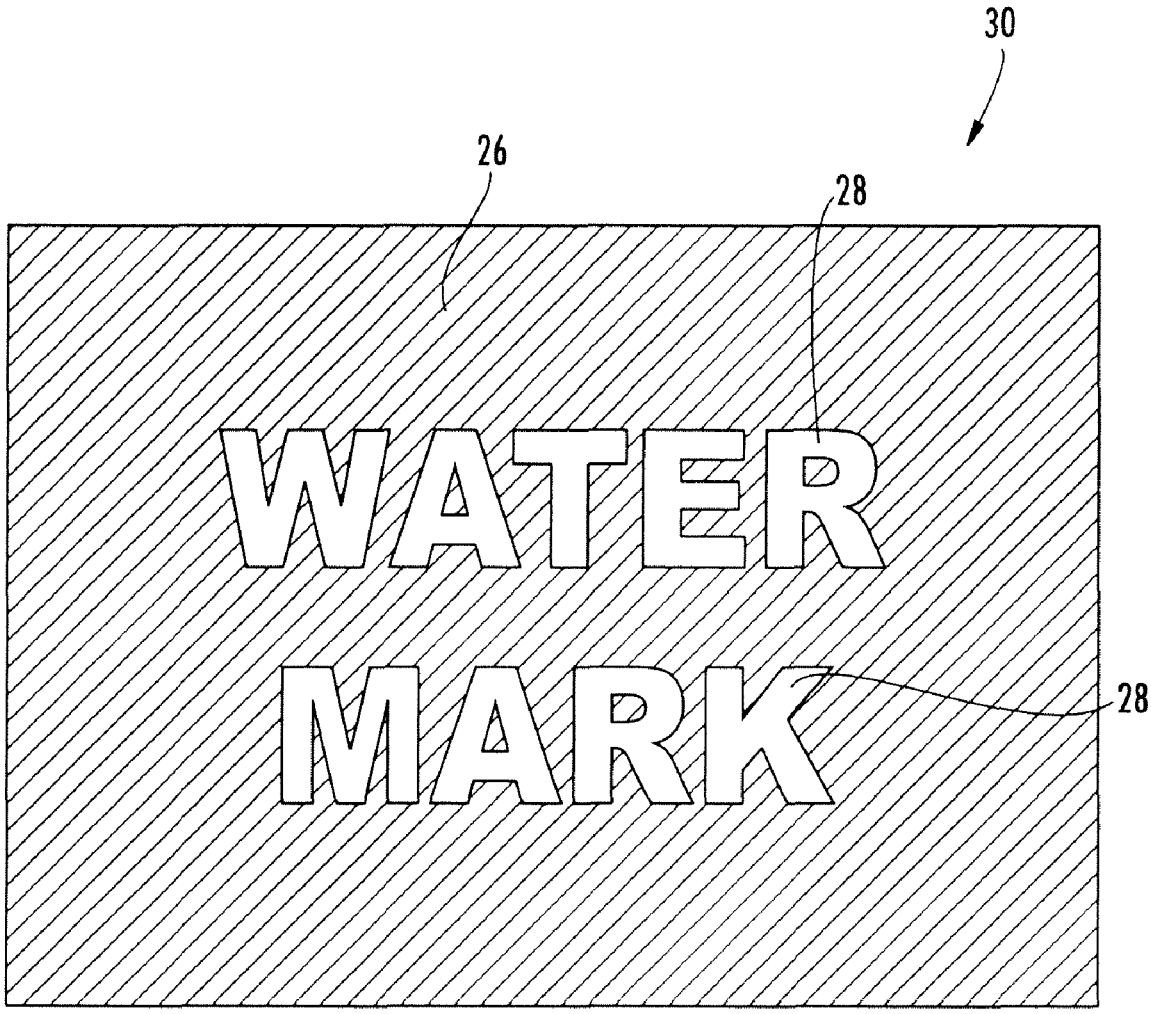
FIG. 8 shows an exemplary fibrous substrate having a false watermark made according to the method shown in FIGS. 1-7.
Figure 16:
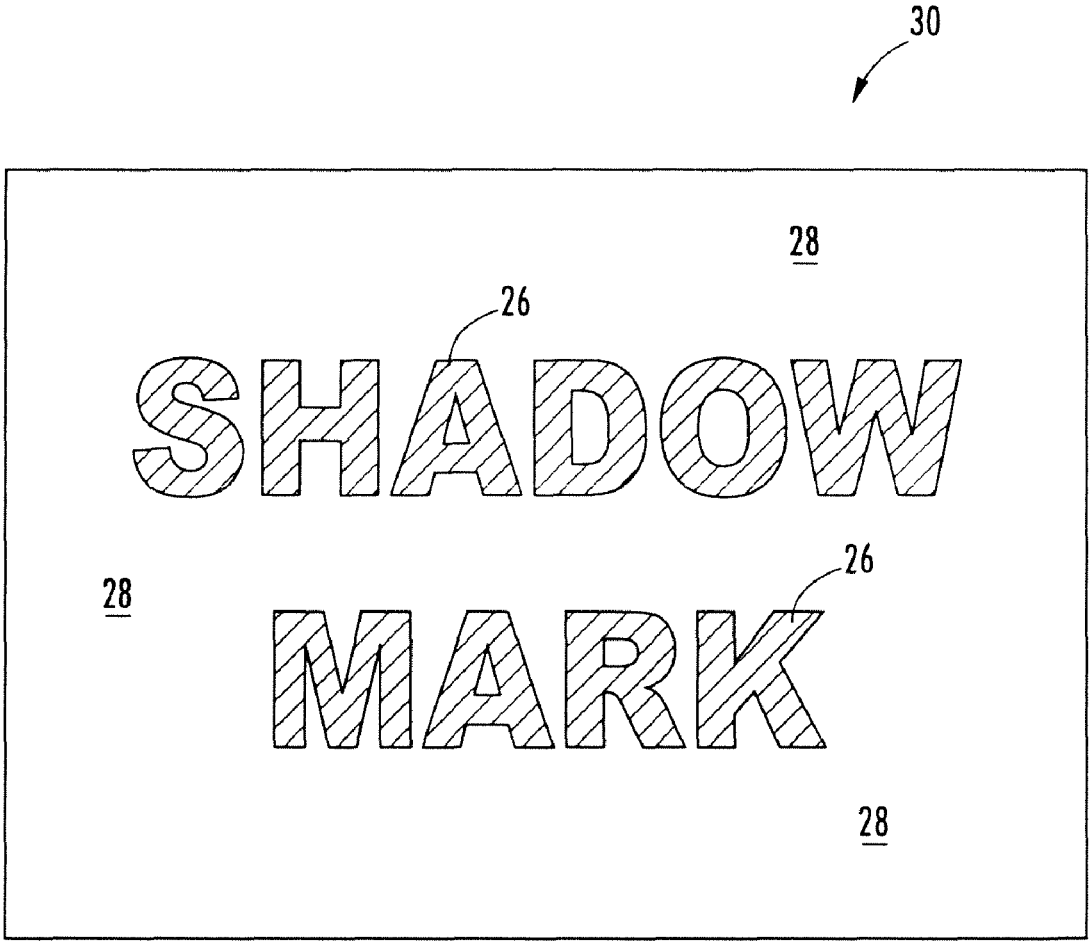
FIG. 16 shows an exemplary fibrous substrate having a false shadow mark made according to the method shown in FIGS. 9-15.

As discussed above, the toner ink 12 can be utilized to form a positive image or a negative toner image on the printable surface 14 of the printable sheet 10. After the application of the toner ink 12 to the printable surface 14, the method of producing the resulting transparency variation image is substantially the same, whether the transparency variation image is a false watermark or a false shadow mark. The method of producing a false watermark (such as shown in FIG. 8) utilizes a negatively applied toner image on the printable surface 14 of the printable sheet 10, and is described in greater detail with respect to FIGS. 1-7. Other than the placement of the toner ink 12 on the printable surface 14 of the printable sheet 10, the following discussion applies equally to a method of making a false shadow mark (such as shown in FIG. 16) with a positive image applied to the printable surface 14 of printable sheet 10, which is depicted in FIGS. 9-15. Thus, one of ordinary skill in the art would be able to apply the following discussion of making a false watermark using the method of FIGS. 1-8 to that of the method shown in FIGS. 9-16 of making a false shadow mark. In any event, the method of making a false shadow mark (such as shown in FIG. 16) with a positive image applied to the printable surface 14 of printable sheet 10 is briefly discussed below following the in depth discussion of FIGS. 1-8.

II. Removing Portions of a Transfer Coating from a Transfer Sheet

Figure 2:
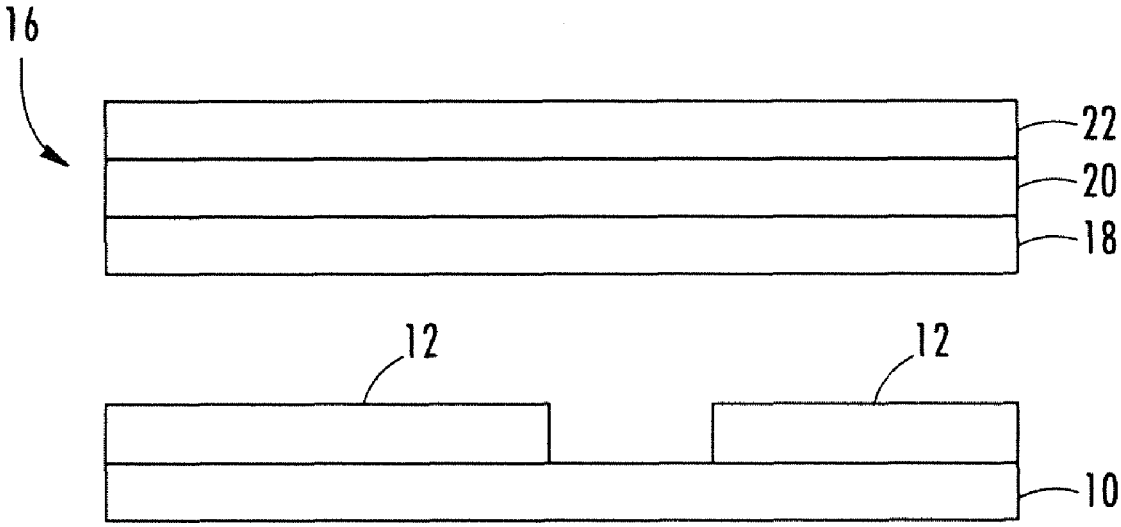

After applying a toner ink 12 onto the printable surface 14 of the printable sheet 10, a transfer coating is removed from a transfer sheet by the toner image on the printable sheet. Specifically, a transfer coating from a transfer sheet is adhered to the printable surface 14 of the printable sheet 10 only in the areas where toner ink 12 is present. Then, the sheets can be separated and the portion of the transfer coating that is adhered to the toner inked areas of the printable sheet is removed from the transfer sheet. The transfer coating can be removed from the transfer sheet at the toner inked areas of the printable surface 14 via heat transfer. For example, FIG. 2 depicts a transfer sheet 16 having a transfer coating 18 overlying a release layer 20 and a base sheet 22. Specifically, in the shown transfer sheet 16, the transfer coating 18 defines an exposed surface of the transfer sheet 16 and overlies the release layer 20. The release layer 20, in turn, overlies the base sheet 22. Although shown as two separate layers in FIGS. 2-4, the release layer 20 can be incorporated within the base sheet 22, so at they appear to be one base layer having release properties.

Figure 3:
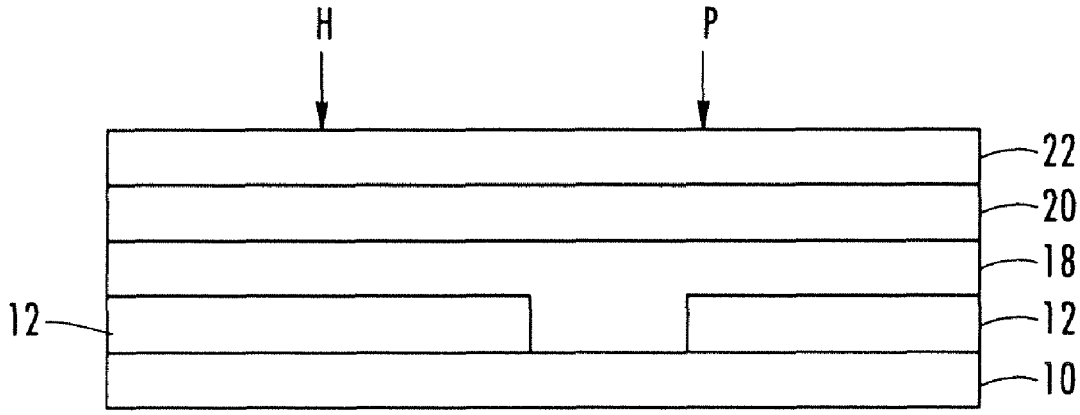
Figure 4:
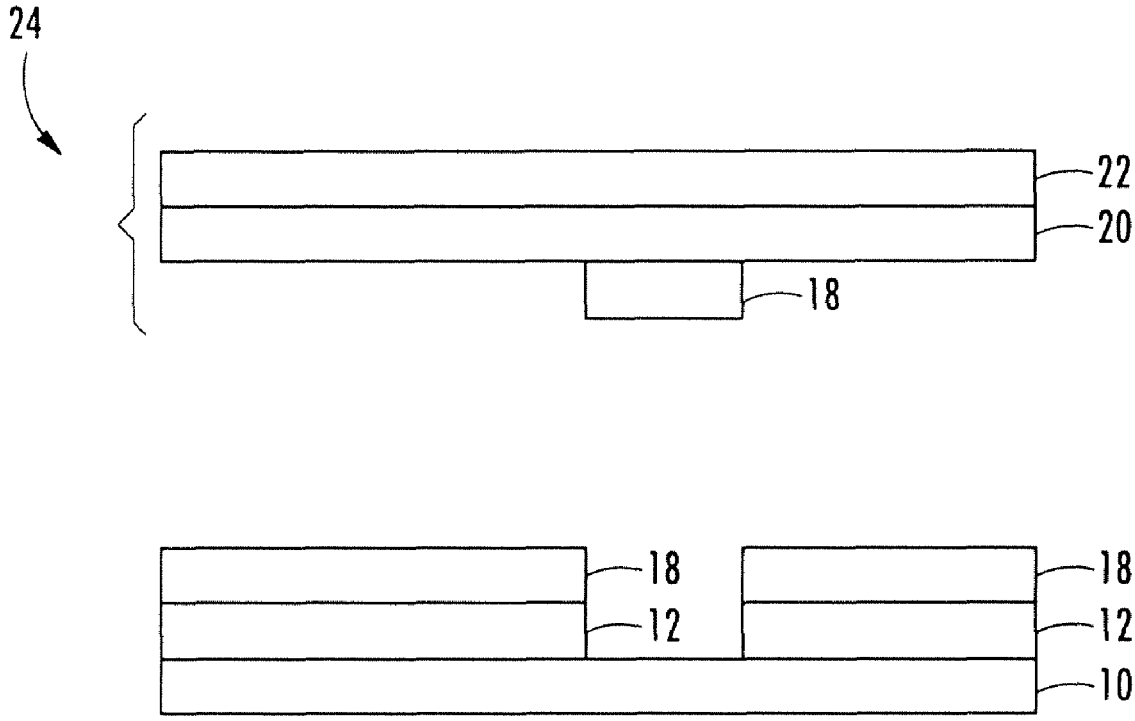

In order to remove the transfer coating 18 from the transfer sheet 16 at the areas of the printable surface 14 where toner ink 12 is present, the transfer sheet 16 is positioned adjacent to the printable sheet 10 such that the transfer coating 18 and the printable surface 14 are in direct contact, as shown in FIGS. 2-4. Upon the application of heat H and pressure P, the transfer coating 18 adheres to the area of the printable surface 14 where toner ink 12 has been applied, but not to the area of the printable surface 14 that is free of toner ink 12. The application of heat H and pressure P laminates the printable sheet 10 and the transfer sheet 16 together as a temporary laminate. When the transfer sheet 16 is separated from the printable sheet 10 (e.g., peeled apart), an intermediate imaged transfer sheet 24 is produced having the transfer coating 18 removed from the transfer sheet 16 only at areas where the toner ink 12 contacted the transfer coating 18. Thus, the negative image applied to the printable sheet 10 becomes a positive image defined by the remaining transfer coating 18 on the intermediate imaged transfer sheet 24. This positive image defined by the remaining transfer coating 18 on the intermediate transfer sheet 24 is the mirror image of the false watermark to be applied to the final fibrous substrate.

Generally speaking, the transfer coating 18 is a coating that includes a film-forming binder and a powdered thermoplastic polymer, either in a single layer or multiple layers. The transfer coating 18 is transparent or becomes transparent after fusing. The temperature required to form the temporary laminate and remove the transfer coating 18 from the transfer sheet 16 at the toner inked areas of the printable surface 14 of the printable sheet 10 is generally below the melting point and softening point of the thermoplastic polymeric material, but is above the melting point of the film-forming binder, in the transfer coating 18. For example, the transfer temperature (i.e., H) can be from about 50° C. to about 150° C., such as from about 80° C. to about 120° C. At this temperature, it is believed that the toner ink 12 softens and melts to become tacky and sufficiently adheres to the transfer coating 18. Thus, after separation, the toner inked areas of the printable sheet 10 adhere to the transfer coating 18 of the transfer sheet 16, while the areas of the printable surface 14 free of toner ink release the transfer coating 18.

Desirably, the transfer coating will include greater than about 10 percent by weight of the film-forming binder and less than about 90 percent by weight of the powdered thermoplastic polymer. In one particular embodiment, the transfer coating includes from about 40% to about 75% of the powdered thermoplastic polymer and from about 20% to about 50% of the film-forming binder (based on the dry weights), such as from about 50% to about 65% of the powdered thermoplastic polymer and from about 25% to about 40% of the film-forming binder.

In general, the powdered thermoplastic polymer will melt in a range of from about 100° C. to about 220° C., such as from about 120° C. to about 200° C. The molecular weight generally influences the melting point properties of the thermoplastic polymer, although the actual molecular weight of the thermoplastic polymer is not as important as the melting point and properties of the melted thermoplastic polymer. In one embodiment, the thermoplastic polymer can have an average molecular weight of about 500 to about 1,000,000. However, as one of ordinary skill in the art would recognize, other properties of the polymer can influence the melting point of the polymer, such as the degree of cross-linking, the degree of branched chains off the polymer backbone, the crystalline structure of the polymer when coated on the transfer sheet 16, etc.

The powdered thermoplastic polymer may be any thermoplastic polymer that meets the melting point criteria set forth herein. For example, the powdered thermoplastic polymer may be a polyamide, polyester, ethylene-vinyl acetate copolymer, polyolefin (e.g., polyethylene, polypropylene, polybutylene, etc.), and so forth. The powdered thermoplastic polymer particle size may be from about 2 to about 50 micrometers in average diameter. In one particular embodiment, the powdered thermoplastic polymer can be a powdered high density polyethylene wax (available as MPP 635G from Micropowders Inc. of Tarrytown, N.Y.) which has a melting point of about 124° C. and an average particle size of about 5 microns.

The film-forming binder has a melting point which may be less than that of the powdered thermoplastic polymer. For example, the film-forming binder will melt between about 50° C. and about 150° C., such as from about 60° C. to about 100° C. Any film-forming binder may be employed which meets the criteria specified herein. As a practical matter, the film-forming binder can generally have a relatively low average molecular weight, so as to have a relatively low melt viscosity to facilitate melting and penetration of the melted coating into the fibrous substrate to form the transparency variation image. A suitable low molecular weight film-forming binder can be a polyethylene oxide having an average molecular weight of about 2000 to about 10,000, such as those commercially available under the tradename CARBOWAX® (Union Carbide, Danbury, Conn.). For example, the film-forming binder can be CARBOWAX® 8000 which is a polyethylene oxide having an average molecular weight of about 8000.

The present inventor has discovered that this specific combination of the powdered thermoplastic polymer and the film-forming binder provides the transfer coating 18 with the ability to temporarily adhere to the inked areas of the printable surface 14 without adhering to, or flowing into, the area of the printable surface 14 that is free of toner ink 12. Thus, when the transfer sheet 16 and the printable sheet 10 are separated after the application of heat and pressure, the transfer coating 18 remains on the printable surface 14 only in the areas where toner ink 12 is present, resulting in the intermediate imaged transfer sheet 24 having the transfer coating 18 removed at areas that match those inked areas of the printable sheet 10.

Additionally, the present inventor has discovered that this specific combination of the powdered thermoplastic polymer and the film-forming binder provides the transfer coating 18 with the ability to be transferred to a fibrous substrate (particularly a paper substrate) to form a transparency variation image on the substrate. As discussed below, the remaining transfer coating 18 on the intermediate imaged transfer sheet 24 will transfer to a fibrous substrate and result in more transparent areas on the substrate. Without being bound by theory, it is believed that the transparency arises from penetration of the melted binder and thermoplastic polymer into the paper, forming polymer/fiber interfaces which replace some of the fiber/air interfaces in the structure of the web. Light scattering at these fiber/polymer interfaces is less than at the fiber/air interfaces in the areas where there are no transferred polymers.

Manufacturers' published data regarding the melt behavior of film-forming binders or powdered thermoplastic polymers correlate with the melting requirements described herein. It should be noted, however, that either a true melting point or a softening point may be given, depending on the nature of the material. For example, materials such a polyolefins and waxes, being composed mainly of linear polymeric molecules, generally melt over a relatively narrow temperature range since they are somewhat crystalline below the melting point. Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined, for example, by ASTM Test Method E-28, is useful in predicting their behavior in the present invention. Moreover, the melting points or softening points described are better indicators of performance in this invention than the chemical nature of the polymer.

Other additives may also be present in the transfer coating. For example, in one particular embodiment, at least one surfactant is present in the transfer coating. Such surfactants will usually be required for dispersion of the thermoplastic polymer particles in the coating. The surfactant(s) can be present in the transfer coating up to about 20%, such as from about 2% to about 15%. In one particular embodiment, a combination of at least two surfactants is present in the transfer coating. In this embodiment, the additional surfactant may provide easier release of the transfer coating from the release coating, as well as helping to disperse the coating ingredients. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co. of Philadelphia, Pa.

The release layer 20 is generally included in the transfer sheet 16 to facilitate the release of the transfer coating 18 to the toner inked areas of the printable surface 14. The release layer 20 can be fabricated from a wide variety of materials well known in the art of making peelable labels, masking tapes, etc. For example, silicone polymers are very useful and well known. In addition, many types of lattices such as acrylics, polyvinylacetates, polystyrenes, polyvinyl alcohols, polyurethanes, polyvinychlorides, as well as many copolymer lattices such as ethylene-vinylacetate copolymers, acrylic copolymers, vinyl chloride-acrylics, vinylacetate acrylics, etc. can be used. In some cases, it may be helpful to add release agents to the release coatings such as soaps, detergents, silicones, etc. The amounts of such release agents can then be adjusted to obtain the desired release.

In one embodiment, the release layer 20 has essentially no tack at transfer temperatures. As used herein, the phrase "having essentially no tack at transfer temperatures" means that the release layer 20 does not stick to the overlying transfer coating 18 to an extent sufficient to adversely affect the quality of the transfer. By way of illustration, the release layer 20 may include a hard acrylic polymer or poly(vinyl acetate). As another example, the release layer may include a thermoplastic polymer having a glass transition temperature ($T_g$) of at least about 25° C. As another example, the glass transition temperature may be in a range of from about 25° C. to about 100° C. Suitable polymers include, for example, polyacrylates, styrene-butadiene copolymers, ethylene vinyl acetate copolymers, nitrile rubbers, poly(vinyl chloride), poly(vinyl acetate), ethylene-acrylate copolymers, and so forth, which have suitable glass transition temperatures.

In another embodiment, the release layer 20 may include a crosslinked polymer. The cross-linked polymer may be formed from a crosslinkable polymeric binder and a crosslinking agent. The crosslinking agent reacts with the crosslinkable polymeric binder to form a 3-dimensional polymeric structure. Generally, it is contemplated that any pair of the polymeric binders and crosslinking agents described above may be utilized in the release layer of the transfer coat sheet material.

The release layer also may include an effective amount of a release-enhancing additive. For example, the release enhancing additive may include a divalent metal ion salt of a fatty acid, a polyethylene glycol, a polysiloxane surfactant, or a mixture thereof. More particularly, the release-enhancing additive may include calcium stearate, a polyethylene glycol having a molecular weight of from about 2,000 to about 100,000, a siloxane polymer polyether, or a mixture thereof.

If desired, the release layer may contain other additives, such as processing aids, pigments, deglossing agents, antifoam agents, rheology control agents and the like. The thickness of the release coatings is not critical. In order to function correctly, the bonding between the transfer coating 18 and the base sheet 22 should be such that about 0.01 to 0.3 pounds per inch of force is required to remove the transfer coating 18 from the base sheet 22 after transfer to the printable sheet 10. If the force is too great, the transfer sheet 16 or the printable sheet 10 may tear when it is removed, or it may stretch and distort. If it is too small, the transfer coating 18 may undesirably detach in processing.

The release layer may have a layer thickness, which varies considerably depending upon a number of factors including, but not limited to, the base sheet 22 to be coated, and the transfer coating 18 applied to it. Typically, the release layer has a thickness of less than about 2 mil (52 microns). More desirably, the release layer has a thickness of about 0.1 mil to about 1.0 mil. Even more desirably, the release layer has a thickness of about 0.2 mil to about 0.8 mil.

The thickness of the release layer may also be described in terms of a basis weight. Desirably, the release coating layer has a basis weight of less than about 45 $g/m^2$, such as from about 2 to about 30 $g/m^2$.

Optionally, the transfer sheet 16 may further include a conformable layer (not shown) between the base sheet 22 and the release layer 20 to facilitate the contact between the transfer coating 18 and the printable surface 14 of the printable sheet 10.

The base sheet 22 can be any sheet material having sufficient strength for handling the coating of the additional layers, the transfer conditions, and the separation of the transfer sheet 16 and the printable sheet 10. For example, the base sheet 22 can be a film or cellulosic nonwoven web. The exact composition, thickness or weight of the base is not critical to the transfer process since the base sheet 22 is removed before the transparency variation image is applied to the substrate. Some examples of possible base sheets 22 include cellulosic non-woven webs and polymeric films. A number of different types of paper are suitable for the present invention including, but not limited to, common litho label paper, bond paper, and latex saturated papers. Generally, a paper backing of about 4 mils thickness is suitable for most applications. For example, the paper may be the type used in familiar office printers or copiers, such as Neenah Paper's Avon White Classic Crest, 24 lb per 1300 sq ft.

The layers applied to the base sheet 22 to form the transfer sheet 16 may be formed on a given layer by known coating techniques, such as by roll, blade, Meyer rod, and air-knife coating procedures. The resulting image transfer material then may be dried by means of, for example, steam-heated drums, air impingement, radiant heating, or some combination thereof.

III. Forming the Transparency Variation Image in the Fibrous Substrate

Figure 5:
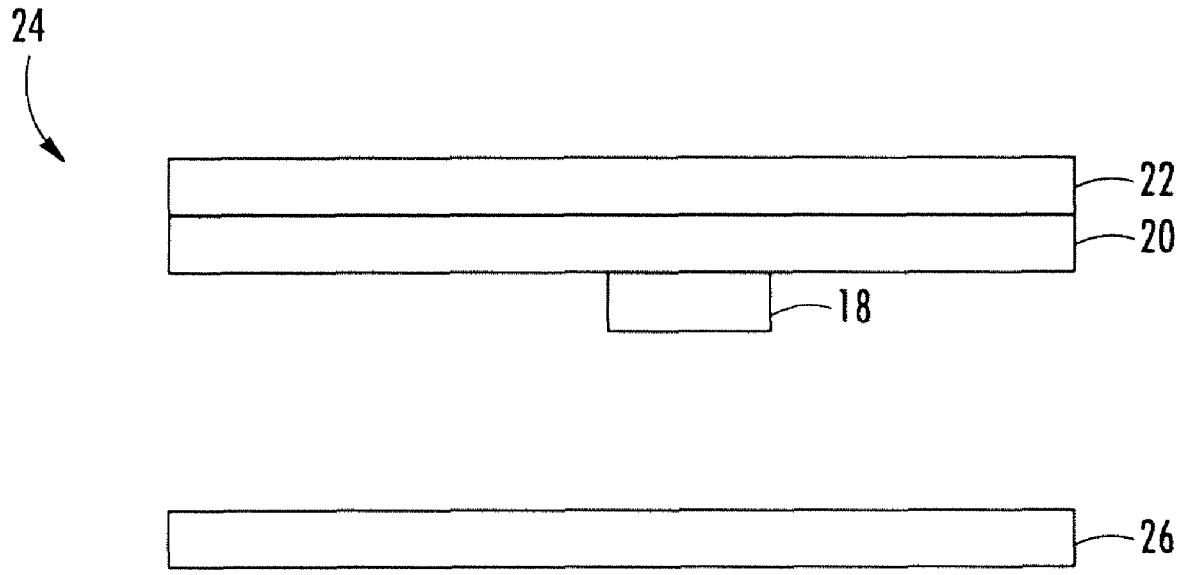
Figure 6:
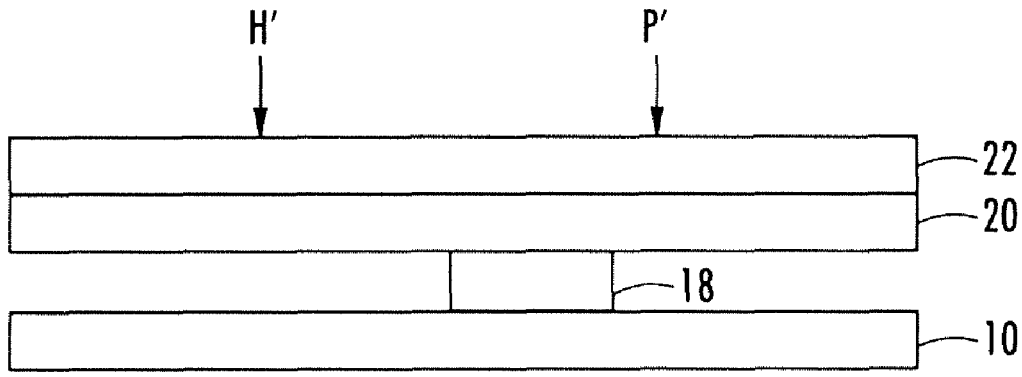
Figure 7:
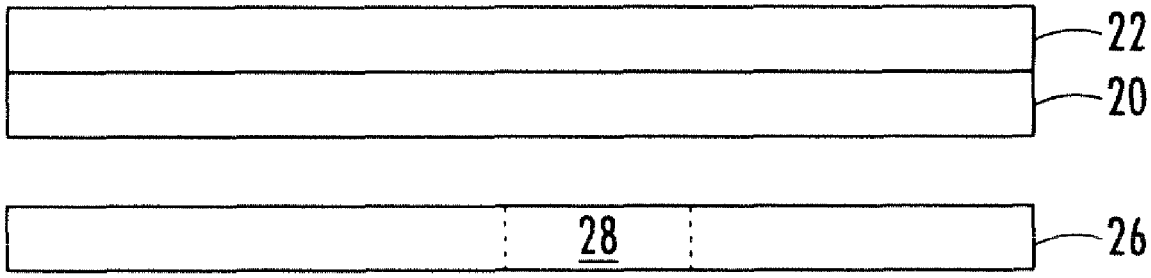

In order to produce a transparency variation image in a fibrous substrate, the intermediate imaged transfer sheet 24 is positioned adjacent the fibrous substrate 26 such that the remaining transfer coating 18 contacts the fibrous substrate 26, as shown in FIGS. 5-6. Upon the application of heat H' and pressure P', the transfer coating 18 softens and flows into the fibrous substrate 26 to form a more transparent area 28, effectively creating the transparency variation image (e.g., the false watermark shown in FIG. 8). Specifically, the transfer coating has a transparentizing affect on the fibrous substrate to allow light to pass through the more transparent areas 28 with greater ease resulting in the more transparent areas 28 appearing lighter. This is believed to be due to replacing some of the fiber/air interfaces with fiber/polymer interfaces, as discussed above.

The transfer temperature of this second transfer step is performed at a higher temperature than the melting point of the powdered thermoplastic polymer, so that the transfer coating 18 softens and flows into the fibrous substrate 26. For example, this second transfer step can have a transfer temperature of more than about 120° C., such as from about 150° C. to about 220° C.

The fibrous substrate 26 typically contains a cellulosic fibrous material (e.g., a paper product). As used herein, the term "cellulosic fibrous material" generally refers to a material that contains wood based-pulps or other non-wood derived fiber sources. The pulp may be a primary fibrous material or a secondary fibrous material ("recycled"). Sources of pulp fibers include, by way of example, woods, such as softwoods and hardwoods; straws and grasses, such as rice, esparto, wheat, rye, and sabai; canes and reeds, such as bagasse; bamboos; woody stalks, such as jute, flax, kenaf, and cannabis; bast, such as linen and ramie; leaves, such as abaca and sisal; and seeds, such as cotton and cotton liners. Softwoods and hardwoods are the more commonly used sources of cellulose fibers.

If desired, synthetic fibers may also be used in conjunction with the cellulosic fibers to increase the tear resistance of the fibrous web. The synthetic fibers may be monocomponent or multicomponent fibers. One example of a multicomponent fiber is comprised of two fibers having differing characteristics combined into a single fiber, commonly called a bicomponent or multicomponent fiber.

Additionally, other additives may also be applied to the fibers. For example, wet-strength agents may be used to improve the strength properties of the web during formation. Other additives may be applied directly to the web or fibers, in conjunction with a binder composition or adhesive coating, or as a separate coating. By way of example, suitable additives may include antifoaming agents, pigments, processing aids, and dispersing agents. The foregoing list of categories of additives and examples of categories is provided by way of example and is not intended to be exhaustive.

As discussed above, forming the transparency variation image in a fibrous substrate according to the presently described methods usually will not substantially affect or alter the thickness of the substrate. For example, the fibrous substrates having a transparency variation image according to the present disclosure can have a substantially uniform thickness (e.g. in a fibrous web, only normal fiber variations in thickness, such as a variation of less than about 0.1% in thickness). Thus, weaknesses in the substrate due to thinner areas in the thickness can be avoided.

In one particular embodiment, the fibrous substrate where the transparency variation image is formed has a relatively smooth surface to allow for crisp transparency variation images. For example, the fibrous substrate can have a Sheffield smoothness of less than about 100, such as less than about 75.

IV. Shadow Mark Method

Other than the placement of the toner ink 12 on the printable surface 14 of the printable sheet 10, the above discussion applies equally to a method of making a false shadow mark (such as shown in FIG. 16) by utilizing a positive image applied to the printable surface 14 of printable sheet 10. The method is sequentially shown in FIGS. 9-15.

Figure 9:
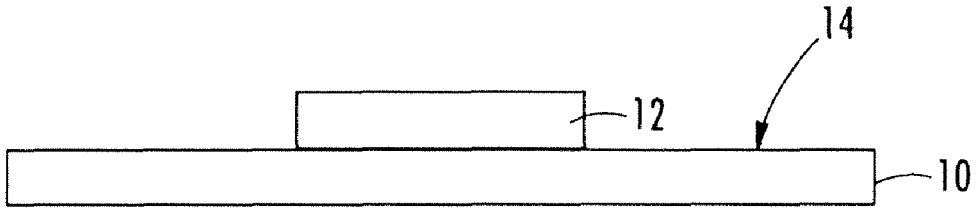
FIGS. 9-15 sequentially depict an exemplary method of making a false shadow mark according to the present invention.

For example, referring to FIG. 9, an exemplary printable sheet 10 is shown having a toner ink 12 applied to its printable surface 14. In FIG. 9, an image is positively formed in the area wherein the toner ink 12 is present, with the remainder of the surface area of the printable surface 14 being free of any toner ink 12.

Figure 10:
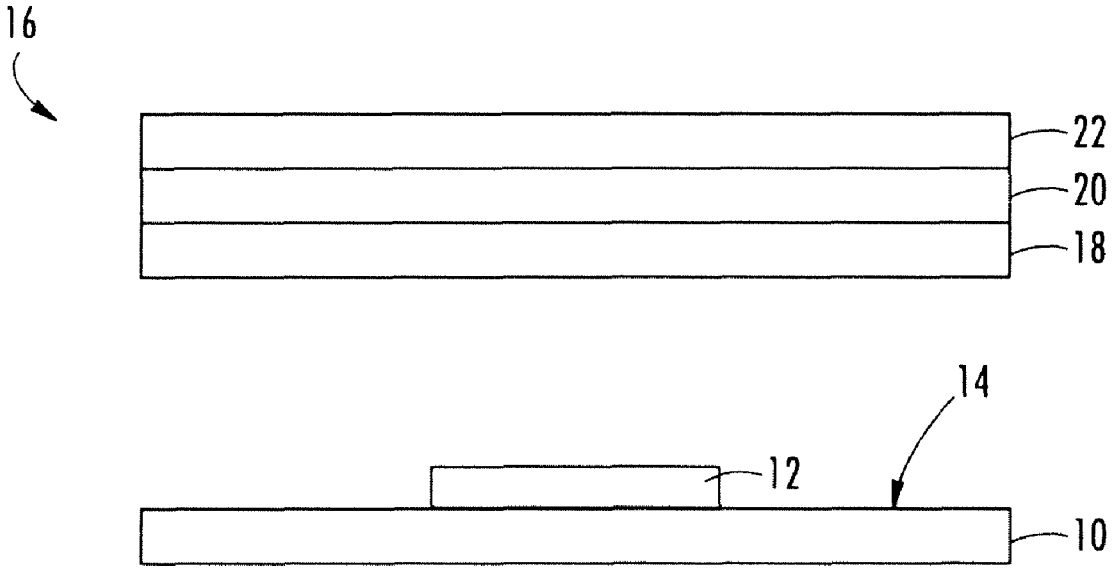
Figure 11:
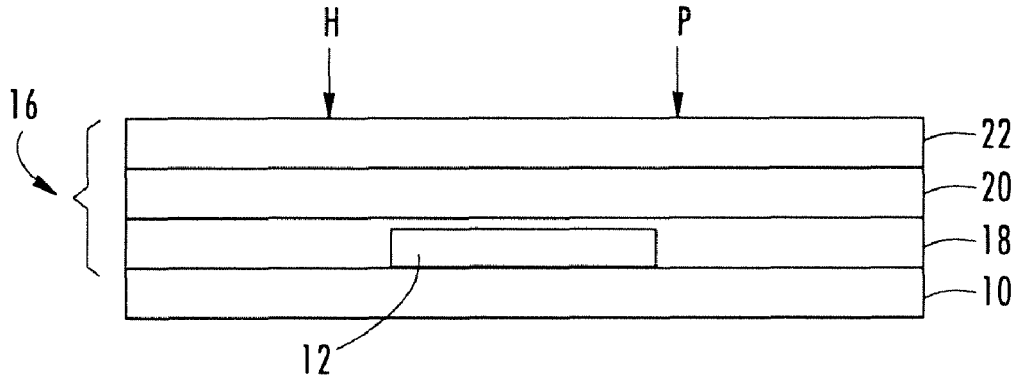
Figure 12:
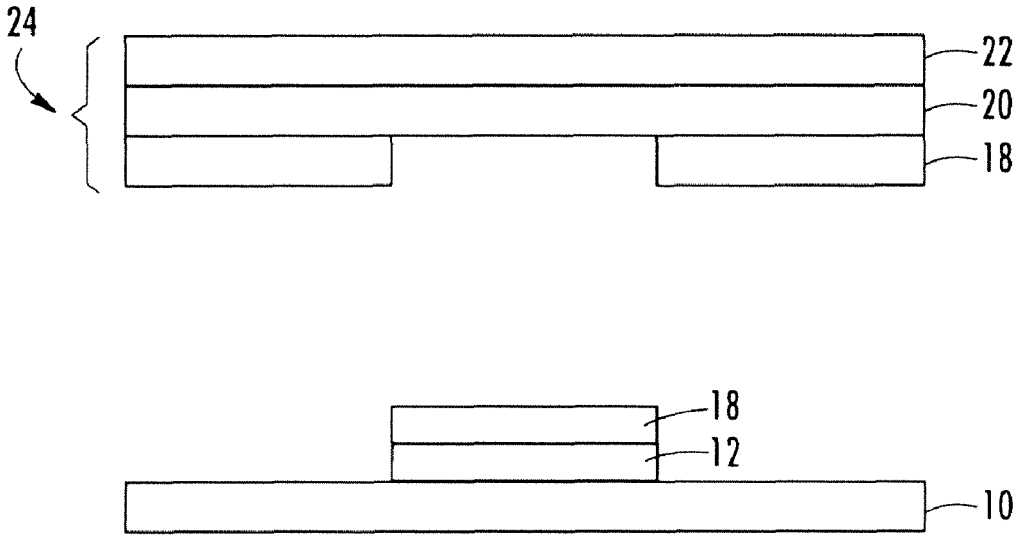

After applying a toner ink 12 onto the printable surface 14 of the printable sheet 10 to form the positively defined image, a transfer coating is removed from a transfer sheet by the toner image on the printable sheet. Specifically, a transfer coating from a transfer sheet is adhered to the printable surface 14 of the printable sheet 10 only in the areas where toner ink 12 is present. Referring to FIGS. 10-12, a transfer sheet 16 is positioned adjacent to the printable sheet 10 such that the transfer coating 18 and the printable surface 14 are in direct contact, as shown in FIG. 10-11. Upon the application of heat H and pressure P, the transfer coating 18 adheres to the area of the printable surface 14 where toner ink 12 has been applied, but not to the area of the printable surface 14 that is free of toner ink 12. The application of heat H and pressure P laminates the printable sheet 10 and the transfer sheet 16 together as a temporary laminate. When the transfer sheet 16 is separated from the printable sheet 10 (e.g., peeled apart), an intermediate imaged transfer sheet 24 is produced having the transfer coating 18 removed from the transfer sheet 16 only at areas where the toner ink 12 contacted the transfer coating 18. Thus, the positive image applied to the printable sheet 10 becomes a negative image defined by the remaining transfer coating 18 on the intermediate imaged transfer sheet 24, as shown in FIG. 12. This negative image defined by the remaining transfer coating 18 on the intermediate transfer sheet 24 is the mirror image of the false shadow mark to be applied to the final fibrous substrate.

Figure 13:
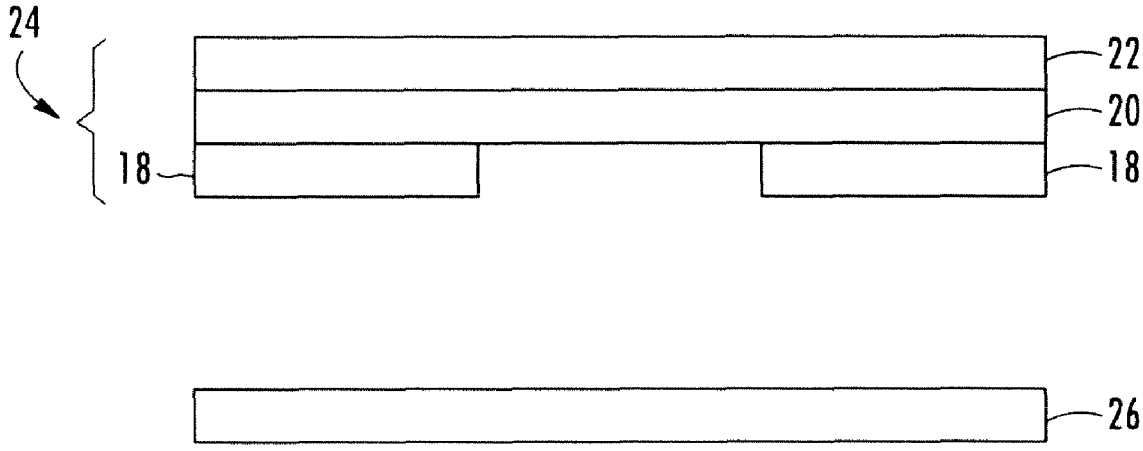
Figure 14:
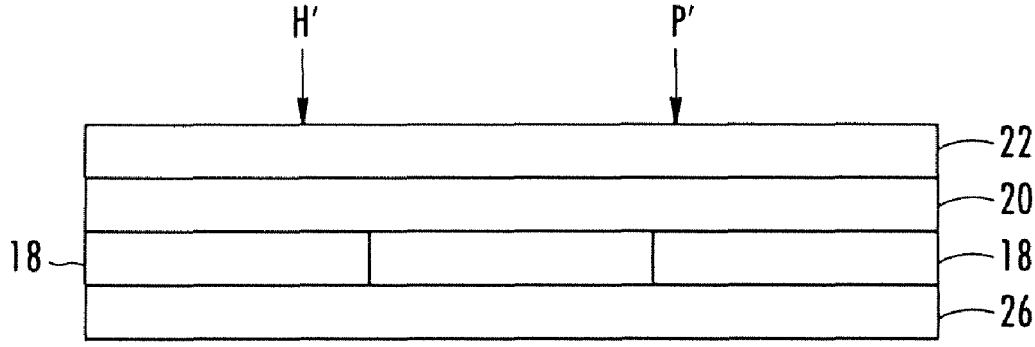
Figure 15:
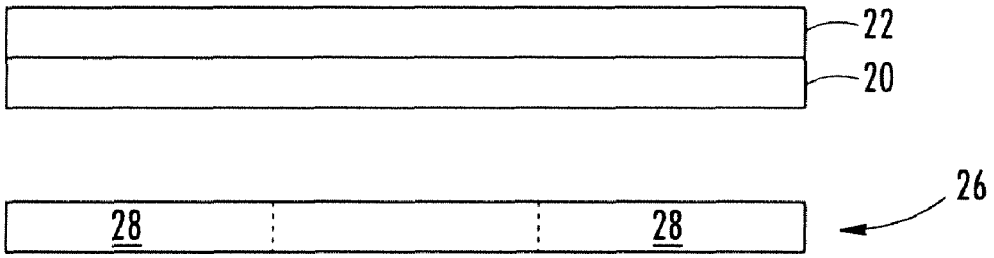

In order to produce a transparency variation image in a fibrous substrate, the intermediate imaged transfer sheet 24 is positioned adjacent the fibrous substrate 26 such that the remaining transfer coating 18 contacts the fibrous substrate 26, as shown in FIGS. 13-14. Upon the application of heat H' and pressure P', the transfer coating 18 softens and flows into the fibrous substrate 26 to form a more transparent area 28, effectively creating the transparency variation image (e.g., the false shadow mark shown in FIG. 16). Specifically, the transfer coating has a transparentizing affect on the fibrous substrate to allow light to pass through the more transparent areas 28 with greater ease resulting in the more transparent areas 28 appearing lighter. This is believed to be due to replacing some of the fiber/air interfaces with fiber/polymer interfaces, as discussed above.

The present invention may be better understood with reference to the following examples.

EXAMPLES

Transfer Sheet

The base paper for the transfer sheet was Neenah Paper Supersmooth Classic Crest, 24 lb. per ream (24 lb. per 1300 square foot). An extruded layer of Elvax 3200 (an ethylene vinylacetate copolymer from Dupont) was applied as a heat conformable layer. A release coating of 2.5 lb. per 1300 square ft. consisting of 100 dry parts of Rhoplex SP 100 (acrylic latex from Rohm and Haas, 5 dry parts of XAMA 7 (crosslinker from BASF), 5 dry parts of Carbowax polyethylene glycol 8000 from Dow chemical and 2 dry parts of Silicone surfactant 190 from Dow Corning was applied over the extruded coating.

A transfer coating was applied to the above release coated paper. The transfer coating was produced by mixing an approximately 37% solids mixture of a powdered high density polyethylene wax available as MPP 635G from Micropowders Inc. of Tarrytown, N.Y. (100 dry parts), a polyethylene oxide available as Carbowax 8000 from Union Carbide, Danbury, Conn. (20 dry parts), a surfactant available as Silicone surfactant 190 from the Dow Corning Corp. (5 dry parts), and a surfactant available as Triton® X-100 from Rohm & Haas Co. of Philadelphia, Pa. (3 dry parts).

Working Examples

Watermarks and shadow marks were produced in a paper substrate according to the methods shown with respect to FIGS. 1-7 and 9-12, respectively. First, a black image (positive for producing a watermark and negative for producing a shadow mark) was digitally printed onto a printable sheet 24 lb. Supersmooth Classic Crest available from Neenah Paper, Inc.) using a Hewlett Packard 4600 printer. Then, the transfer coating from the transfer sheet was transferred to the toner inked areas of the printable sheet at a transfer temperature of about 200° F. (about 92° C.). After separating the transfer sheets and the printable sheets, the transfer sheets were heat pressed with sheets of Neenah paper 24# Supersmooth Classic Crest in a heat press at 375° F. (about 189° C.) for 15 seconds and the papers were separated to form paper sheets with watermarks and shadow marks, respectively.

The same procedure was then used to form watermarks and shadow marks in Neenah Paper 60 lb. cardstock.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method of producing a transparency variation image in a fibrous substrate, the method comprising:

removing a portion of a transfer coating from a transfer sheet via heat transfer with a printable sheet defining a printable surface, wherein the portion of the transfer coating removed from the transfer sheet corresponds to areas where a toner ink is present on the printable surface of the printable sheet, wherein the transfer coating comprises a film forming binder and a powdered thermoplastic polymer, and wherein the transfer is performed at a first transfer temperature of between about 50° C. and about 150° C.; and transferring the transfer coating remaining on the transfer sheet to a fibrous substrate at a second transfer temperature of greater than about 150° C. to form a transparency variation image in the fibrous substrate.

2. A method as in claim 1, wherein the powdered thermoplastic polymer has a melting point of greater than about 100° C.

3. A method as in claim 2, wherein the film-forming binder has a melting point that is less than the melting point of the powdered thermoplastic polymer.

4. A method as in claim 1, wherein the powdered thermoplastic polymer has a melting point of between about 120° C. and about 220° C.

5. A method as in claim 1, wherein the powdered thermoplastic polymer comprises a polyolefin.

6. A method as in claim 1, wherein the film-forming binder has a melting point of between about 50° C. and about 150° C.

7. A method as in claim 1, wherein the film-forming binder has a melting point of between about 60° C. and about 100° C.

8. A method as in claim 1, wherein the film-forming binder comprises a polyethylene oxide having an average molecular weight of between about 2000 and about 10,000.

9. A method as in claim 1, wherein the transfer coating further comprises a surfactant.

10. A method as in claim 1, wherein the transfer coating further comprises at least two surfactants, wherein at least one of the surfactants comprises a nonionic surfactant.

11. A method as in claim 1, wherein the transfer coating comprises the powdered thermoplastic polymer from about 40% by weight to about 75% by weight and the film-forming binder from about 20% by weight to about 50% by weight based on dry weights.

12. A method of producing a transparency variation image in a fibrous substrate, the method comprising:

printing a toner ink onto a printable surface of a printable sheet to form toner inked areas on the printable surface and areas free of toner ink on the printable surface;

positioning a transfer sheet adjacent to the printable sheet such that a transfer coating of the transfer sheet contacts the printable surface of the printable sheet to form a temporary laminate, wherein the transfer sheet comprises the transfer coating overlying a release layer overlying a base sheet, wherein the transfer coating comprises a film forming binder having a melting point between about 50° C. and about 120° C. and a powdered thermoplastic polymer having a melting point of greater than about 100° C.;

heating the temporary laminate to a temperature of between about 50° C. and about 150° C.;

separating the transfer sheet from the printable sheet such that the transfer coating is transferred to the printable sheet only at the inked areas;

thereafter, positioning the transfer sheet in contact with a cellulosic nonwoven web such that the remaining transfer coating contacts the cellulosic nonwoven web; and transferring the remaining transfer coating from the transfer sheet to the cellulosic nonwoven web at a transfer temperature of greater than about 150° C. to form a transparency variation image in the cellulosic nonwoven web.

13. A method as in claim 12, wherein the powdered thermoplastic polymer has a melting point of between about 80° C. and about 220° C.

14. A method as in claim 12, wherein the powdered thermoplastic polymer comprises a polyolefin.

15. A method as in claim 12, wherein the film-forming binder has a melting point of between about 60° C. and about 75° C.

16. A method as in claim 12, wherein the film-forming binder comprises a polyethylene oxide having an average molecular weight of between about 2000 and about 10,000.

17. A method as in claim 12, wherein the transfer coating further comprises at least one surfactant.

18. A method as in claim 12, wherein the transfer coating comprises the powdered thermoplastic polymer from about 40% by weight to about 75% by weight and the film-forming binder from about 20% by weight to about 50% by weight based on dry weights.

19. A method as in claim 12, wherein the toner ink printed onto the printable surface of the printable sheet defines a negative image such that the method results in a false watermark applied to the cellulosic nonwoven web.

20. A method as in claim 12, wherein the toner ink printed onto the printable surface of the printable sheet defines a positive image such that the method results in a false shadow mark applied to the cellulosic nonwoven web.

21. An intermediate imaged transfer sheet for use in forming a transparency variation image in a fibrous substrate, the intermediate imaged transfer sheet comprising:

a base sheet;

a release layer overlying the base sheet; and a transfer coating overlying the release layer, wherein the transfer coating defines an outer surface of the intermediate imaged transfer sheet, wherein the transfer coating defines an image, and wherein the transfer coating comprises a film forming binder and a powdered thermoplastic polymer, the powdered thermoplastic polymer having a melting point of greater than about 80° C., and the film-forming binder having a melting point of between about 50° C. and about 120° C.

22. The method as in claim 1, wherein the transfer coating has a transparentizing effect on the fibrous substrate resulting in transparent areas having a lighter appearance.

23. The method as in claim 19, wherein the transfer coating has a transparentizing effect on the fibrous substrate resulting in transparent areas having a lighter appearance.

24. The intermediate imaged transfer sheet as in claim 21, wherein the transfer coating is configured to have a transparentizing effect when transferred to a fibrous substrate resulting in transparent areas having a lighter appearance.

* * * * *